United States Patent [19]

White, Sr.

[11] 4,078,801

[45] Mar. 14, 1978

[54] ROAD HOCKEY PUCK

[76] Inventor: Thomas Paul White, Sr., 159 King Street, East, St. John, New Brunswick, Canada, E2L 1G9

[21] Appl. No.: 723,642

[22] Filed: Sep. 15, 1976

Related U.S. Application Data

[63] Continuation-in-part of Ser. No. 320,176, Jan. 2, 1973, Pat. No. 3,997,164, which is a continuation of Ser. No. 51,310, Jun. 30, 1970, abandoned.

[51] Int. Cl.[2] ..... A63B 71/00

[52] U.S. Cl. ..... 273/128 R

[58] Field of Search ..... 273/128 R, 128 CS, 128 A, 273/106 R, 1 B; 272/107

[56] References Cited

U.S. PATENT DOCUMENTS

| | | | |
|---|---|---|---|
| 3,704,891 | 12/1972 | Chiarelli | 273/128 R |
| 3,726,526 | 4/1973 | Radovich | 273/128 R |

FOREIGN PATENT DOCUMENTS

| | | | |
|---|---|---|---|
| 339,812 | 9/1921 | Germany | 272/107 |
| 347,948 | 1/1922 | Germany | 272/107 |

*Primary Examiner*—Richard C. Pinkham
*Assistant Examiner*—T. Brown
*Attorney, Agent, or Firm*—Cushman, Darby & Cushman

[57] ABSTRACT

A puck for playing an ice hockey-like game, on untraditional surfaces, is provided with a generally cylindrical body of foam rubber or the like. Two smaller-diameter disks or end plates of glide material are secured coaxially therewith on respective opposite ends of the body. Several ways of connecting the disks and main body together are disclosed, including ones calling for adhesives, spin welding and ultrasonic welding. In some instances, a provision is made within the main body and between the end disks to receive weights. A way is disclosed for installing a selected amount of internal weighting after the disks and main body have been secured together.

17 Claims, 10 Drawing Figures

Fig. 1
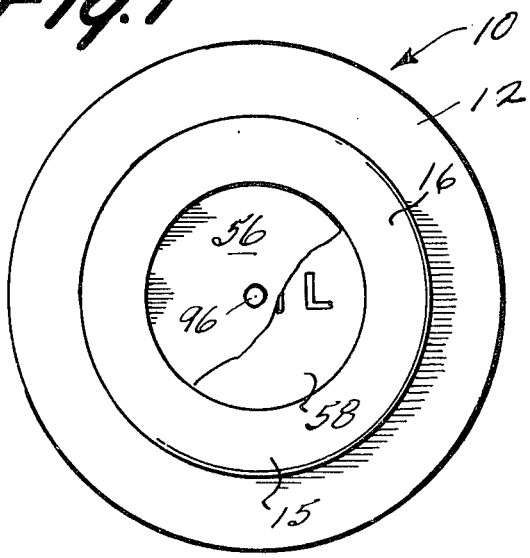
Fig. 2
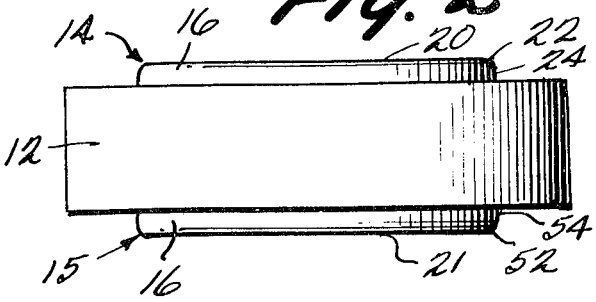
Fig. 3
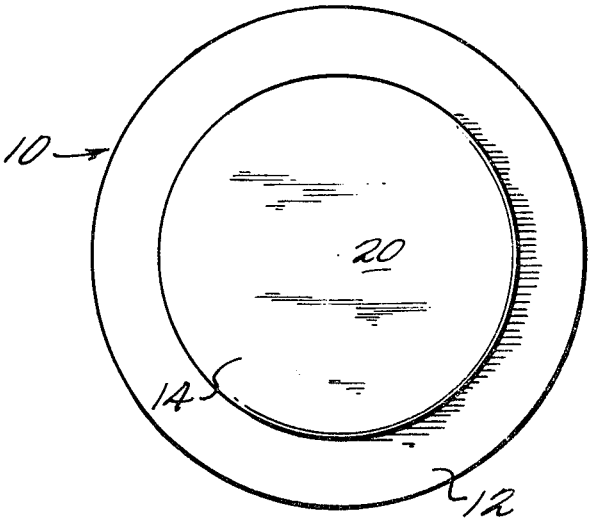
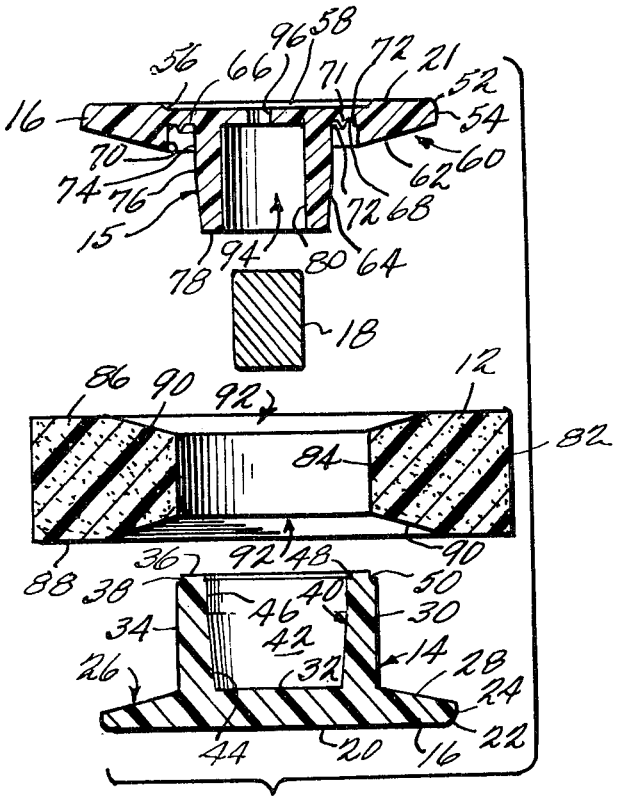
Fig. 5
Fig. 4
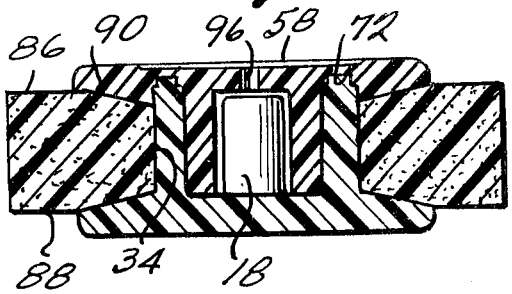

ROAD HOCKEY PUCK

REFERENCE TO RELATED APPLICATION

This is a continuation in part of my earlier, copending U.S. patent application Ser. No. 320,176, filed Jan. 2, 1973, now U.S. Pat. No. 3,997,164, issued Dec. 14, 1976, which is, in turn, a continuation of Ser. No. 51,310, filed June 30, 1970, and abandoned in favor thereof.

BACKGROUND OF THE INVENTION

The game of road hockey bears a similar relation to ice hockey as soft ball bears to hard ball. The rules are similar, and a similar puck is put in play between, about and in similar goals, by people manipulating similar sticks to those used in normal play of ice hockey. A stick specially designed to be used as a road hockey stick is disclosed in my U.S. Pat. No. 3,377,065, issued Apr. 9, 1968 and another Pat. 2,529,825, issued Sept. 22, 1970.

Because road hockey can be as enjoyable to play for recreation as it can be to play in an essentially competitive spirit, it is enjoyable for a greater number of participants each time an innovation makes it safer to play, provided in enhances or does not reduce the basic similarities between the games. Many who play road hockey also play ice hockey and most at least follow the latter sport. Thus, it is important that a road hockey puck when passed or shot act in flight and in interaction with sticks much like an ice hockey puck does. It is easy to see that a traditional ice hockey puck, if used for road hockey, may make the game too rough to be played by people wearing no more physical protection than street clothes, except those keen enough to avoid or tolerate injury.

Road hockey can be played on convenient hard surfaces like play grounds, parking lots, roads or even on ice.

SUMMARY OF THE INVENTION

In my aforesaid patent, more about the game of road hockey is set forth, as are several designs of road hockey pucks. In view of the availability of copies of that patent, its disclosure is not duplicated here.

In the course of time and with further experience, I have made what I believe to be refinements of these basically good designs of road hockey pucks. They are described herein.

The present invention provides a puck for playing an ice hockey-like game, on untraditional surfaces, which is provided with a generally cylindrical body of foam rubber or the like. Two smaller-diameter disks or end plates of glide material are secured coaxially therewith on respective opposite ends of the body. Several ways of connecting the disks and main body together are disclosed, including ones calling for adhesives, spin welding and ultrasonic welding. In some instances, a provision is made within the main body and between the end disks to receive weights. A way is disclosed for installing a selected amount of internal weighting after the discs and main body have been secured together.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS IN THE DRAWINGS

FIG. 1 is a top plan view of a presently preferred embodiment of the road hockey puck of the invention;

FIG. 2 is a side elevation view of the puck of FIG. 1,

FIG. 3 is a bottom plan view thereof;

FIG. 4 is a longitudinal cross-sectional view thereof; and

FIG. 5 is an exploded longitudinal cross-sectional view of the parts thereof during assembly.

DETAILED DESCRIPTION OF THE PRESENTLY PREFERRED EMBODIMENT OF THE INVENTION

Figure 8:
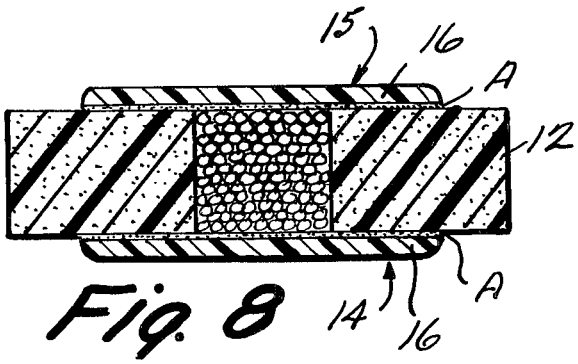
FIG. 8 is a longitudinal cross-sectional view of the parts of another modification, wherein the end disks are adhered face-to-face to the main body of the road hockey puck.

Referring to FIGS. 1–5, the road hockey puck 10 is assembled from a main body 12, and two end plate members 14, 15 bearing end disks 16. Internal weighting means 18 is preferably provided within the main body 12, between the end disks 16. The puck 10 should weigh no more than a regular ice hockey puck, 170.1 grams (six ounces). However, it is preferable for the puck 10 to be somewhat less massive, though substantially the same size as a regular ice hockey puck. For instance, the puck 10 (not counting the weight 18) may weigh about 120 grams and the weighting means 18 weigh up to about 15 grams.

Typically, the main body 12 measures 8.572 cm diameter by 2.222 cm thickness and the end disks 16 6.35 cm diameter by 0.476 cm thickness.

The main body 12 is made of material that is substantially less dense than the hard rubber of conventional ice hockey pucks. The ideal material is one (a) durable enough to withstand being shot against the boards placed about the perimeter of the playing surface, and (b) resilient enough to be used in the play of road hockey by players wearing no more rugged protection than blue jeans or the like, yet (c) not so flexible that when the puck hits the boards or a person, the main body compresses enough to let the disks 16 smack against the boards or persons. A material I presently prefer to use to make the main body is a durable and relatively firm foam rubber known as Nuron Crepe which is available in sheets from American Biltrite Inc., Tech. Sq., Cambridge, Mass. and Sherbrooke, Quebec. The main body may be cut from that sheet material.

The end plate members 14, 15 are made of denser material with good axially outwardly presented glide surfaces 20, 21. I presently prefer to injection mold the end plate members 14, 15 of a thermoplastic material such as high density polyethylene that can be ultrasonically welded or spin welded to itself, or which permits the end plate members to be adhered to the main body or to one another.

The weighting means 18 is preferably lead or steel shot or one or more slugs or sleeves of those or similarly weighty materials.

In the preferred embodiment shown, the end plate member 14 has a circular disk 16 with a flat axially outer glide surface 20, filleted at 22 at the radially outer edge 24 of the disk. The axially inner face 26 of the disk has a shallow, coaxial, annular frustoconical surface 28 which extends axially away from the surface 20 as it proceeds radially inwardly from the edge 24. A tubular flange 30 is based on the surface 26 intermediate the radial extent thereof. The flange 30 is also coaxial with the surface 28. Radially inwardly of the tubular flange 30, the surface 26 has a flat central portion 32.

The radially outer surface 34 of the flange 30 is preferably cylindrically curved from its base until just short of the annular flat, free end surface 36, whereupon the surface 34 undergoes a slight, abrupt reduction in diameter to provide a circumferential band 38 of slightly smaller diameter.

The radially inner surface 40 of the flange 30 and the flat wall portion 32 together define a socket 42. From the base thereof, the surface 40 is first steeply frustoconical at 44, having for instance a 5° taper along somewhat over half the length of the surface 40. Then the surface 40 becomes substantially cylindrical in the region 46 which extends until just short of the end surface 36, whereupon the surface 40 undergoes an abrupt slight increase in diameter to provide a circumferential band 48 of slightly greater diameter. The net effect of providing the bands 38 and 48 is that the flange 30 has an abrupt slight decrease in web thickness at 50 immediately adjacent the end surface 36.

The end plate member 15 has a circular disk 16 with a generally flat axially outer glide surface 21, filleted at 52 at the radially outer edge 54 of the disk. A very shallow, e.g. circular recess 56 may be provided in the surface 21 for receiving a decal, label or the like 58 bearing a logograph of the puck manufacturer, a particular sports team or the like. The recess 56 preferably has the same depth and figure as the label 58 so that when the label 58 is in place, the recess 56 is completely filled.

The axially inner face 60 of the disk 16 of the end plate member 15 has a shallow, coaxial, annular, frustoconical surface 62 which extends axially away from the surface 60 as it proceeds radially inwardly from the edge 54.

A tubular flange 64 is coaxially, centrally provided on the face 60. The annular portion of the inner face of the disk radially extending between the radially inner extent of the surface 62 and the base of the flange 64 is circumferentially relieved to provide a trough 66. The trough 66 has a flat circular floor 68, i.e. patterned to complement the end surface 36. The trough 66 has a radially outer wall 70 that is substantially cylindrical from its mouth, except for undergoing an abrupt slight reduction in diameter immediately adjacent the floor 68 to provide a circumferential band 72 of slightly smaller diameter. The trough 66 has a radially inner wall 74 that is substantially cylindrical from its mouth, except for undergoing an abrupt slight increase in diameter immediately adjacent the floor 68 to provide a circumferential band 72 of slightly larger diameter. The net effect is to provide the trough 66 with a slight decrease in web thickness immediately adjacent the floor 68.

The wall 74 continues to be cylindrically curved a short distance above the mouth of the trough 66, then becomes steeply frustoconically curved at 76, to the flat annular end surface 78 of the flange 64.

The shape of the radially inner wall 80 of the flange 64 is less important in this embodiment; in the instance depicted, it is generally cylindrical.

The main body 12 is of ring shape, which, in cross section is seen to have a generally cylindrical radially outer surface 82, a generally cylindrical radially inner surface 84 coaxial therewith and end surfaces 86, 88 that are substantially flat, except for missing a shallow coaxial frustoconical portion over about half the radial extent of each end surface 86, 88 immediately adjacent the radially inner surface 84. That results in the provision of coaxial frustoconical annular surfaces 90 which proceed axially toward one another as they proceed radially inwardly defining the floors of recesses 92.

The backsides of the disks 16 are tapered to make the disks strong and thick by the bases of the respective tubular flanges, without making the disks that thick all the way out to their outer peripheries.

The parts are so sized that the tubular flange 30 is about the same diameter as the central opening through the main body. Thus when the flange 30 is pushed into the opening 98, it frictionally engages the radially inner surface 84, connecting these two parts together. When the flange 30 is pushed in to its hilt, the frustoconical surface on the backside of the disk 16 of the end plate member 14 complementarily engages the frustoconical surface 90 on the respective end of the main body. In other words, the thickened part of the backside of the disk 16 of the end plate member fills the recess on the respective end of the main body. At this point, the end surface 36 of the flange 30 is e.g. slightly axially beyond the plane of the radially outer flat part of the opposite end 86 of the main body 12.

After the parts 12 and 14 are assembled together, the tubular flange of the end plate member 15 is coaxially presented toward the socket 42. If the subassembly 12, 14 and part 15 are then brought axially together, the end surface 78 of the flange 64 bottoms on the floor of the socket 42 and all of the tubular flange 30 that extends into the respective recess 92 is received in the trough 66. The taper on the outside of the flange 64 and in the socket 42 provides ample clearance as the flange 64 enters the socket 42. Then as assembly continues, these two steeply tapered surfaces complementarily engage and the thinner web end portion of the flange 30 is squeezed between the circumferential bands where the trough 66 is narrower near its floor, providing an interference fit. Then a conventional ultrasonic welding horn (not shown) is applied against the surface 21 of 56 to cause ultrasonic welding in the region of the interference fit. That unites the parts 12, 14 and 15. Assisted by an annular energy director 71.

Where it is desired that the puck 10 be heavier than it would be if made only of foam rubber and high density polyethylene, a body or bodies of weighting material 18 may be put in the cavity 94 radially inwardly of the flange 64, wall 80 before the part 15 is assembled to the subcombination 12, 14 and/or a small filler port 96 may be formed e.g. axially centrally through the disk 16 of the end plate 15. Then, even after the part 15 is secured to the subassembly 12, 14, weighting means 18 in the form of small shot pellets or the like may be dropped into the cavity 94 through the opening 96. When about enough weighting means has been added, the opening may be closed, e.g. by melting it closed with the tip of a hot soldering iron or clothes iron. Or it can be blocked by applying the label thereover and or pouring a settable composition such as rubber cement or melted wax into the cavity filling the remainder thereof.

It should be particularly noted that the effect of providing the trough 66 is that the site of the ultrasonic welding is moved close to outer surface 21 of the part 15. This considerably facilitates providing a good weld.

Figure 6:
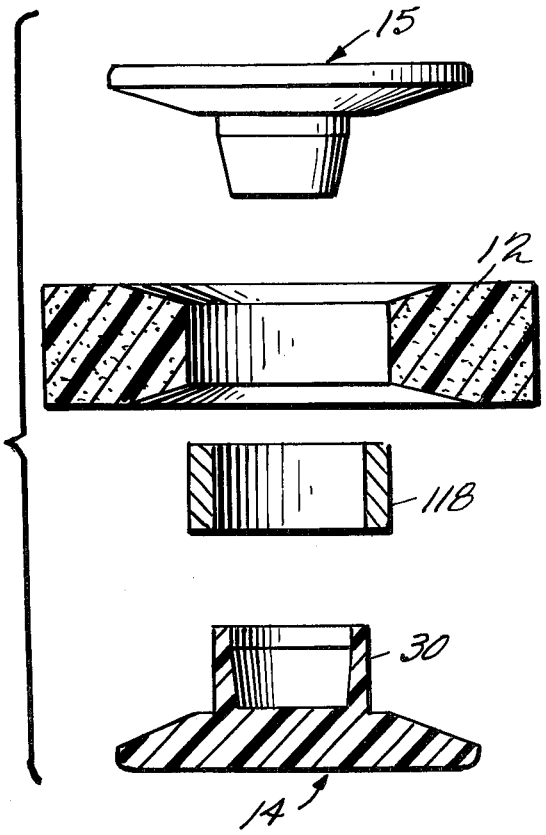
FIG. 6 is an exploded longitudinal cross-sectional view of the parts of a variation, with a modified weighting provision.

In the variation shown in FIG. 6, the opening centrally through the main body is made somewhat larger in diameter, just enough so that a tubular collar 118 of weighting material can be coaxially interposed between the outside of the flange 30 and radially inner surface of the main body during assembly of the end plate 14 to the main body 12. The collar 118 may be provided in addition to or instead of the weighting means 18 shown in FIGS. 1-5.

Figure 7:
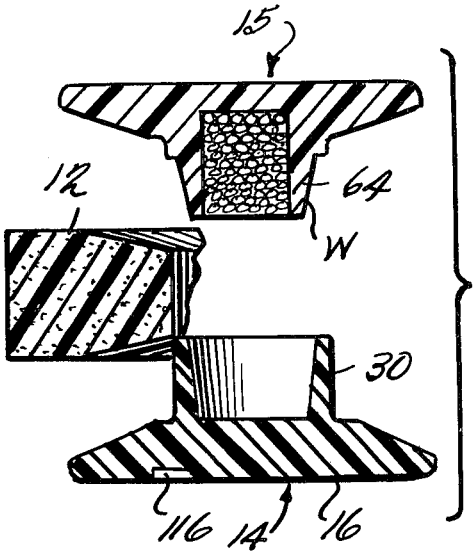
FIG. 7 is an exploded longitudinal cross-sectional view of the parts of another variation, with disk parts especially designed to be united by spin welding.

In the variation shown in FIG. 7, a plurality of recesses 116 are provided in the outer face of at least one of the disks 16. The recesses 116 are, for instance, arranged in a circular array centered upon the respective disk. To unite the part 15 with the subassembly 12, 14 a conventional spin welding chuck is inserted in the recesses and rotated to spin one end plate member 14 with respect to the end plate member as the parts are pressed together. Frictional heat generated between the steep frustoconical surfaces on the outside of the flange 64 and the inside of the flange 30 cause a weld W to be made at their interface as rotation is terminated and the chuck removed.

Weighting may be provided for the FIG. 7 embodiment in the same way as is described above with references to FIGS. 1-5 and 6.

Although provision of the shallow tapered, progressively thickened portions on the backsides of the disks 16 and the corresponding recesses in the ends of the main body, there are instances where the disk backsides and main body ends may be made flat at those sites and manufacture of the recesses 92 omitted, a simplification applicable to the constructions shown in FIGS. 1-5, 6 and 7.

In the variation shown in FIG. 8, each end plate member 14, 15 is constituted by a disk 16 without tubular flange on its inner face. The disks 16 are coaxially secured to the respective end faces of the main body 12 using a suitable adhesive A. In the instance of this variation, the main disk may have its central opening filled with weighting bodies before the second of the disks 16 is secured in place, or the opening may be left empty or omitted, or after both main disks are secured in place, the cavity between the disks 16 within the main body opening may be filled through a filler port provided through one disk 16, with a filling of shot pellets or the like. Then the filler port can be closed as explained above with reference to the embodiment of FIGS. 1-5.

It should now be apparent that the road hockey puck as described hereinabove, possesses each of the attributes set forth in the specification under the heading "Summary of the Invention" hereinbefore. Because the road hockey puck of the invention can be modified to some extent without departing from the principles of the invention as they have been outlined and explained in this specification, the present invention should be understood as encompassing all such modifications as are within the spirit and scope of the following claims.

Figure 9:
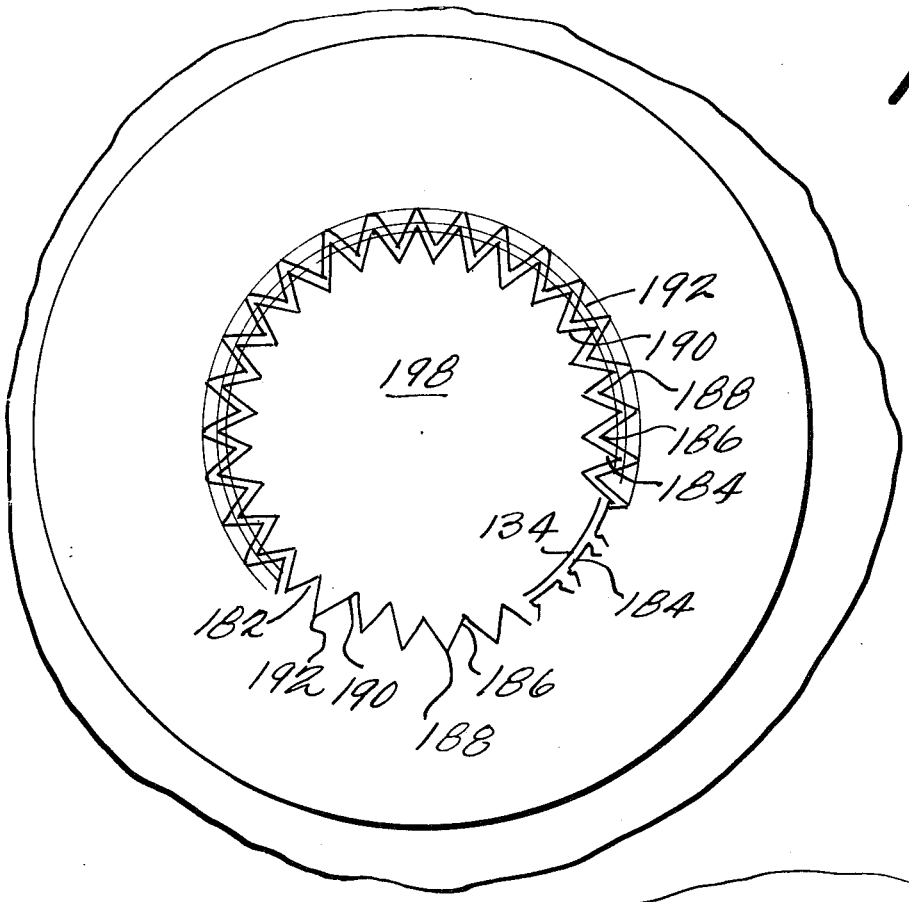
FIG. 9 is a top plan view of a variation of the inside diameter wall of the main body specially designed to accept an outsized flange and to frictionally grasp and retain same.

In the variation shown in FIG. 9 the opening 198 centrally through the main body 12 when it is molded by the blowing agent method which tends to shrink when curing has a puckered inside diameter wall formed by triangles 182 which extend axially radially from the apexes 190 to the bases 192. In the process of curing the triangles 182 shrink to a smaller size 180 and the bases 192 are withdrawn axially radially by the shrinkage of the main body 12 to a new position 188 and it follows that the apexes are necessarily withdrawn to a new position 186 which is a greater inside diameter than 190 but of lesser inside diameter than the wall 134 of the flange which is thrust into said opening 198 thus when the flange is inserted into the central opening 198 the apexes 184 are compressed sufficiently enough to allow entry of the plastic flange while at the same time now frictionally grasping the wall 134, thus supplying a fit which is neither too loose nor too tight, either condition of which would be detrimental to the functional fit of the main body 12 and the plastic flange wall 134.

Figure 10:
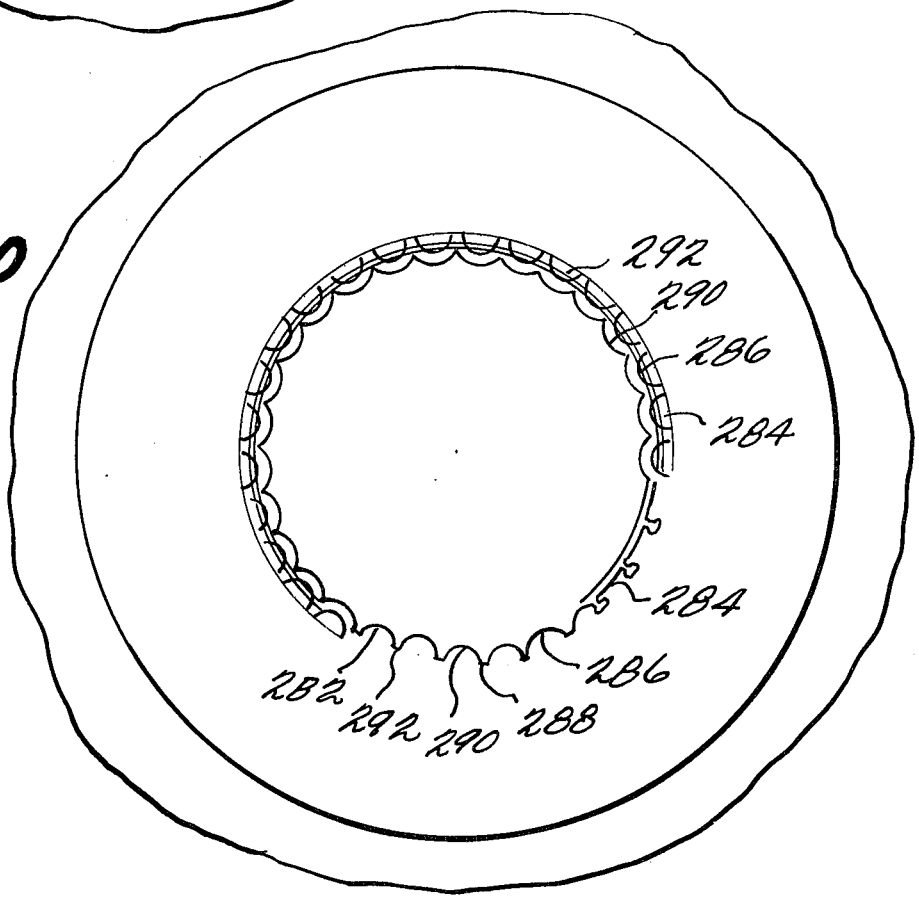
FIG. 10 is a top plan view of still another modification of the inside diameter wall of the main body designed to likewise accept an outsized flange and frictionally grasp and retain same.

In the variation shown in FIG. 10 the pucker is moulded in curved convolutions 282 at a dimension 292 arching at 290 then shrinking to the dimensioning represented at 288 and 286 then when the flange is inserted the outer diameter of its wall 234 will compress the arcs 286 into a surface 284 which is now frictionally grasping wall 234.

What is claimed is:

1. A puck for playing road hockey, comprising:

a generally cylindrical main body of foam rubber, having two opposite ends with an outer peripheral sidewall extending therebetween;

two disks of plastic material, each being substantially thinner, of lesser diameter and more dense and rigid than the main body;

the main body having means defining a central opening therethrough;

a tubular flange coaxially, integrally extending inwardly from each disk, to provide two respective end plate members, these two tubular flanges being telescoped one within the other and engaging one another;

at least one of the tubular flanges being fused to the respective other end plate member to unite the two disks and main body together as a unit;

the relation of the resilience of the foam rubber of the main body to the difference of diameter between the disks and the main body being chosen to ensure that when the puck is slapped directly against a rigid vertical surface, such as a hockey rink board, at a speed typical of an ice hockey slap shot (about 33.64 to as much as about 49.34 meters per second) the portion of the main body which extends radially outwardly from the peripheries of the disks does not collapse so much as to permit the peripheries of the disks to slam against said rigid vertical surface, while said foam rubber being substantially more resilient than the hard rubber which is used for conventional ice hockey pucks; and said puck weighing between 110 grams and 170.1 grams so that it has a weight on the order of that of conventional ice hockey pucks, which weigh 6 ounces (170.1 grams).

2. The road hockey puck of claim 1, wherein:

at least one of said disks has exteriorly exposed detent means for accepting a spin welding chuck for spinning that disk with respect to the other disk; and said one tubular flange being fused to the respective other end plate member by a spin weld.

3. The road hockey puck of claim 2, wherein:

the disks are made of synthetic polymerized plastic material.

4. The road hockey puck of claim 3 wherein:

the disks are made of high density polyethylene.

5. The road hockey puck of claim 2, wherein:

the main body has means defining a central opening therethrough and wherein at least one body of weighting material having a density that is substantially greater than those of the main body and disks is received in the central opening and housed therein between said disks.

6. The road hockey puck of claim 5, wherein:

the weighting material comprises a plurality of metal shot pellets; and one of the disks is provided with a small diameter shot introduction port for allowing said central opening to be loaded with shot after the disks have been adhered to the main body.

7. The road hockey puck of claim 6, wherein:

said one disk has means defining a shallow, flat-bottomed recess in the outer face thereof and the shot introduction port emerges from said one disk through the flat bottom of said recess; and further including a label secured to said flat bottom covering the shot introduction port and substantially filling the recess.

8. The road hockey puck of claim 1, wherein:

said one tubular flange extends into and is interference fit within means defining a ring-shaped recess in the backside of the disk of the respective other end plate member having an annular energy director;

said one tubular flange being fused to the respective other end plate member within said ring-shaped recess by an ultrasonic weld.

9. The road hockey puck of claim 8, wherein:

the disks are made of synthetic polymerized plastic material.

10. The road hockey puck of claim 9, wherein:

the disks are made of high density polyethylene.

11. The road hockey puck of claim 8, wherein:

the main body has means defining a central opening therethrough and wherein at least one body of weighting material having a density that is substantially greater than those of the main body and disks is received in the central opening and housed therein between said disks.

12. The road hockey puck of claim 11, wherein:

the weighting material comprises a plurality of metal shot pellets; and one of the disks is provided with a small diameter shot introduction port for allowing said central opening to be loaded with shot after the disks have been adhered to the main body.

13. The road hockey puck of claim 12, wherein:

said one disk has means defining a shallow, flat-bottomed recess in the outer face thereof and the shot introduction port emerges from said one disk through the flat bottom of said recess; and further indcluding a label secured to said flat bottom covering the shot introduction port and substantially filling the recess.

14. The road hockey puck of claim 13 wherein: the label has a means defining a central opening therethrough substantially of a size corresponding to the shot introduction filler port and in a position which will allow entry to the said filler port thus allowing the ultimate consumer to fill the weight retaining chamber to an extent that will best suit his own purposes and allow him to seal the filler port or close the mouth thereof to an extent that will prevent the shot pellets from escaping after he has loaded the chamber to an amount of his own choosing.

15. The road hockey puck of claim 1 wherein: the inside diameter wall of said central opening has means defining a puckered surface axially radially.

16. The road hockey puck of claim 15 wherein: the puckered surface of said wall is formed by a plurality of triangular shapes extending axially radially thereto the main body.

17. The road hockey puck of claim 15 wherein: the puckered surface of the inside wall is a plurality of arcs forming said inside wall of convolutions axially radially to the main body.

* * * * *